US006238119B1

(12) United States Patent
Liu

(10) Patent No.: US 6,238,119 B1
(45) Date of Patent: May 29, 2001

(54) PHOTO-PEN WITH THE FUNCTION OF DISPLAYING A PHONE CALLING AND ILLUMINATION IN DARK

(76) Inventor: Robert Liu, No.2, Lane 71, Man Ping St., Panchiao, Taipei Hsien (TW)

( * ) Notice: Subject to any disclaimer, the term of this patent is extended or adjusted under 35 U.S.C. 154(b) by 0 days.

(21) Appl. No.: 09/565,465

(22) Filed: May 5, 2000

(51) Int. Cl.[7] ..... B43K 29/00

(52) U.S. Cl. ..... 401/195; 401/52; 401/192; 362/118

(58) Field of Search ..... 401/52, 195, 192; 362/118, 184, 234, 253

(56) References Cited

U.S. PATENT DOCUMENTS 5,803,583 * 9/1998 Hsieh ..... 401/195
5,939,702 * 8/1999 Knighton et al. ..... 401/195
6,129,473 * 10/2000 Shu ..... 401/195

* cited by examiner

*Primary Examiner*—Gregory L. Huson
*Assistant Examiner*—Tuan Nguyen
(74) *Attorney, Agent, or Firm*—Rosenberg, Klein & Lee

(57) ABSTRACT

A photo-pen with the function of displaying a phone calling and illumination in dark comprises a pen head, a pen body, and an inducing light emitter. The pen head has an inner pen tube. The pen body is installed at a distal end of the pen head, have a battery therein and having a transparent portion. The inducing light emitter is received within the pen body and has an inducing circuit board electrically connected to the battery and is controlled by a switch key. The inducing circuit board is installed with at least one first light emitter and at least one second light emitter. The first light emitter is placed at the distal end of the pen body and is covered by the distal cover; and the second light emitter is placed at the second section tube.

7 Claims, 4 Drawing Sheets

PHOTO-PEN WITH THE FUNCTION OF DISPLAYING A PHONE CALLING AND ILLUMINATION IN DARK

FIELD OF THE INVENTION

The present invention relates to a photo-pen with the function of displaying a phone calling and illumination in dark, which combines the functions of writing, displaying mobile phone calling and illumination, and is a portable device.

BACKGROUND OF THE INVENTION

Conventionally, pen is used in writing, but due to progress in technology, other function is combined to a pen for expansion the functions thereof so as to add the worth of a pen. Some pens having LEDs or laser diodes for illumination or indication or amusement have commercially sold. In other aspect, communication is more and more popular. Mobile phones have become a popular products. Almost any one has one handset. Some devices which can be inserted into a handset for displaying a calling have commercially sold. However, such devices are designed as a decoration, or is combined with an antenna, or as a doll. There is only single one function.

Therefore, there is an eager demand for a novel photo-pen with the function of displaying a phone calling and illumination in dark, which has multiple functions improving the prior art defect of single one function.

SUMMARY OF THE INVENTION

Accordingly, the primary object of the present invention is to provide a photo-pen with the function of displaying a phone calling and illumnination in dark which combines the functions of writing, displaying mobile phone calling and illumination, and is a portable device.

In order to achieve aforesaid objects, the present invention provides a photo-pen with the function of displaying a phone calling and illumination in dark comprising a pen head, a pen body, and an inducing light emitter. The pen head has an inner pen tube. The pen body is installed at a distal end of the pen head, have a battery therein and having a transparent portion. The inducing light emitter is received within the pen body and has an inducing circuit board electrically connected to the battery and is controlled by a switch key. The inducing circuit board is installed with at least one first light emitter and at least one second light emitter. The first light emitter is placed at the distal end of the pen body and is covered by the distal cover; and the second light emitter is placed at the second section tube.

The various objects and advantages of the present invention will be more readily understood from the following detailed description when reading in conjunction with the appended drawing.

DETAILED DESCRIPTION OF THE PREFERRED EMBODIMENTS

Figure 1:
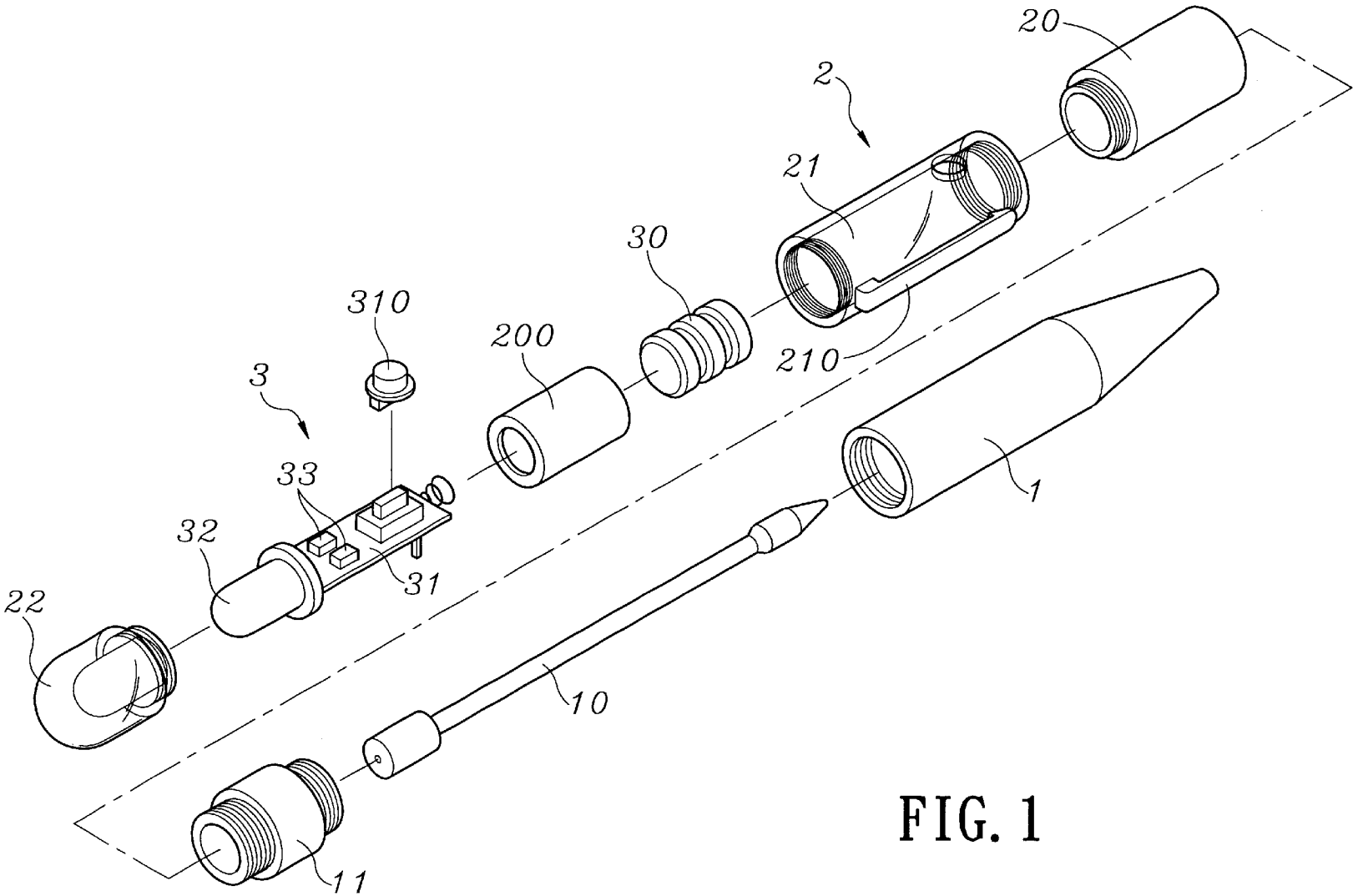
FIG. 1 is an exploded perspective view of the present invention.
Figure 2:
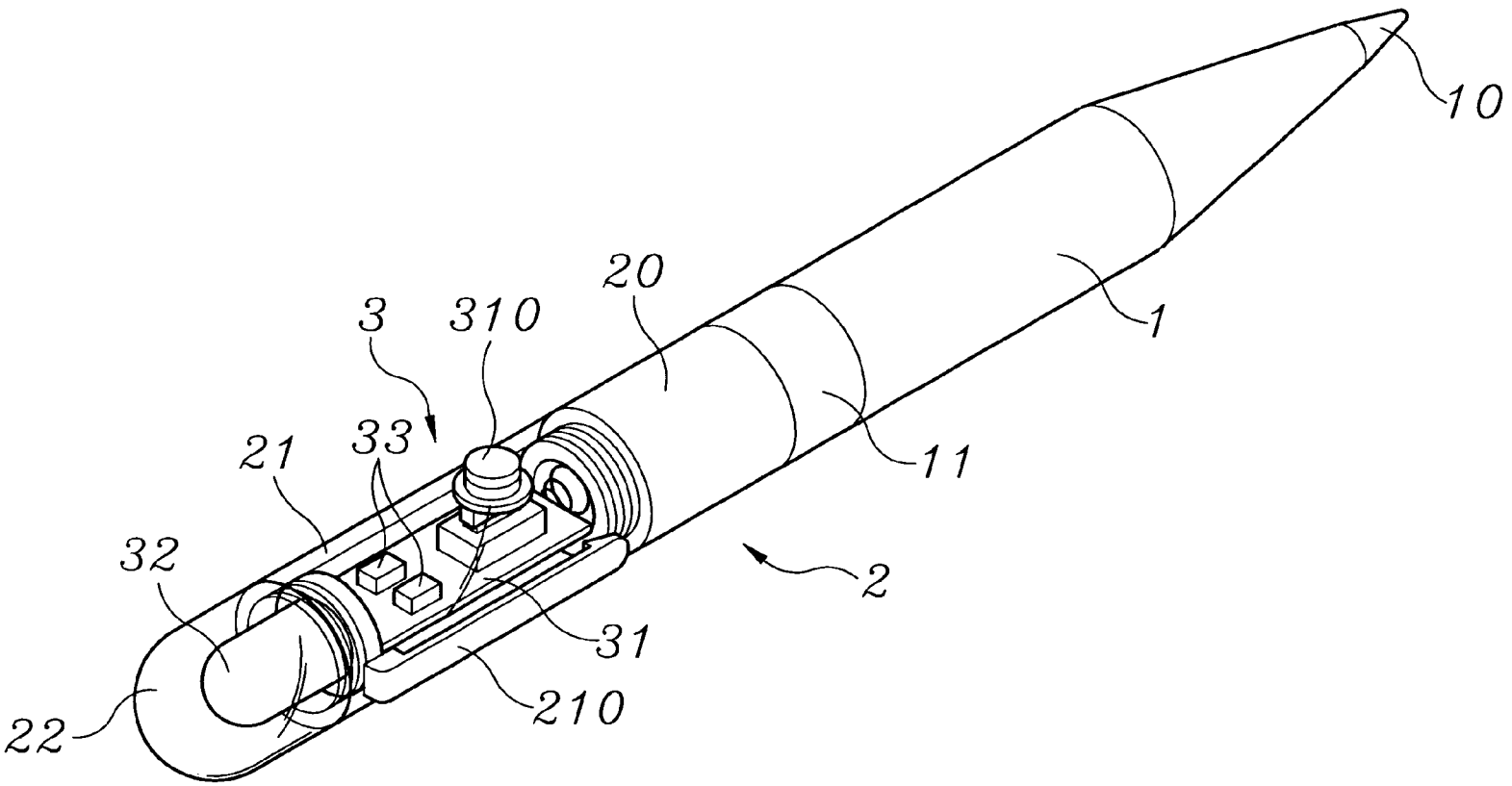
FIG. 2 is an assembled perspective view of the present invention.
Figure 3:
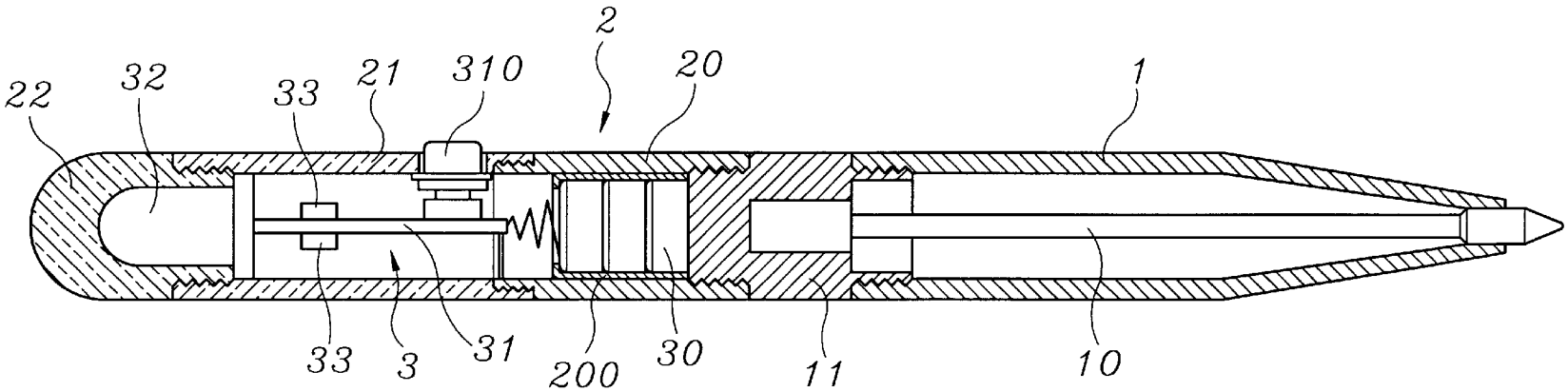
FIG. 3 is an assembled cross sectional view of the present invention.

With reference to FIGS. 1 to 3, the exploded and assembly views of the photo-pen with the function of displaying a phone calling and illumination in dark according to the present invention are illustrated. The photo-pen of the present invention includes a head 1, a pen body 2 and an inducing light emitter 3.

The head 1 has an inner pen tube 10 therein for writing. The inner pen tube 10 is assembled at a metal seat in the distal end of the head 1.

The pen body 2 is formed by a metal first section tube 20 and a second section tube 21 made of transparent material. The first section tube 20 is screwedly connected to another end of the seat 11. An insulated sleeve 200 is provided therein for receiving a battery 30. The second section tube 21 is appended with a transparent pen clipper 210 and the distal end thereof is screwedly connected to a transparent distal cover 22. The inducing light emitter 3 is received within the pen body 2, includes an inducing circuit board 31 electrically connected to the battery 30 and is controlled by a switch key 310. The inducing circuit board 31 is installed with at least one first light emitter 32 and at least one second light emitter 33. The first light emitter is placed at the distal end of the pen body 2 and is covered by the distal cover 22. The second light emitter is placed at the second section tube 21. The first light emitter 32 and the second light emitter 33 may be LEDs, and are varied in colors. For example, a R, G, or B single lamp, RG, RB or RY double lamps, RGB triple lamps (wherein R: red, G: green, B: blue). The first light emitter 32 serves for illumination. The second section tube 33 serves to present variation of different lights according to the setting of a program in the inducing circuit board 31. Moreover, the inducing circuit in the inducing circuit board 31 can induce the signal from a mobile phone and thereby cause the second light emitter 33, even the first light emitter 32, to light up according to a preset mode so as to provide a function of display the phone call.

Figure 5:
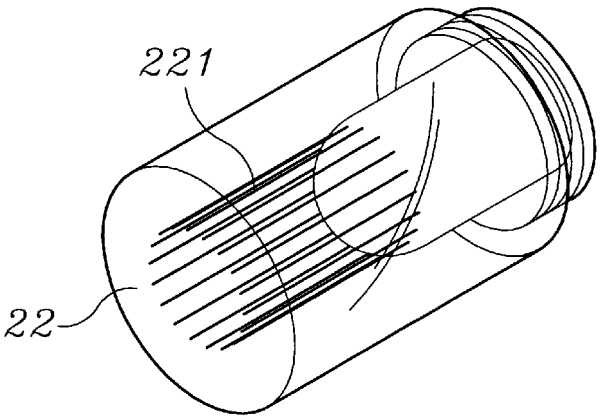
FIG. 5 is a perspective view showing a further embodiment of the transparent distal cover of the present invention.
Figure 7:
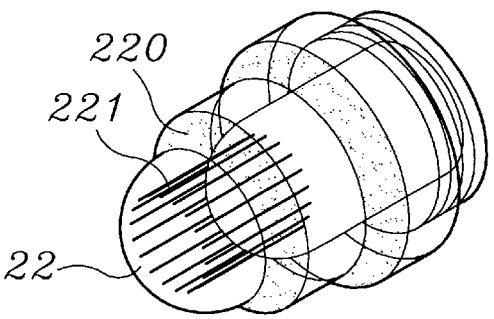
FIG. 7 is a perspective view showing the other embodiment of the transparent distal cover of the present invention.
Figure 4:
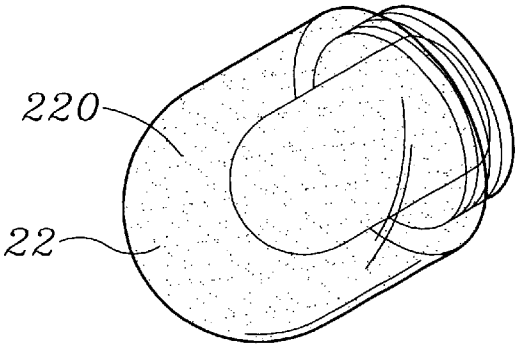
FIG. 4 is a perspective view showing one embodiment of the transparent distal cover of the present invention.
Figure 6:
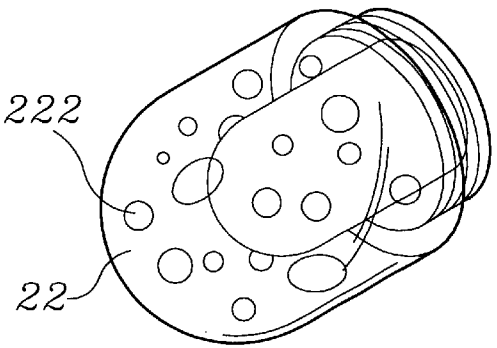
FIG. 6 is a perspective view showing another embodiment of the transparent distal cover of the present invention.

Besides, the transparent distal cover 22 covering on the first light emitter 32 can be formed as a whole transparent configuration as shown in FIGS. 1 to 3, or as a vague shape with small particles 220 thereon as shown in FIG. 4, or have a plurality of parallel fiber tubes 221 as shown in FIG. 5 and thus emit strip shape light, or include a plurality of small bulbs 222 as shown in FIG. 6; or includes a plurality of fiber tubes 221 and circle round arranged small particles 220 as shown in FIG. 7.

The pen body as shown in FIG. 2 has basic writing function. When the mobile phone of the user receives a call, the second light emitter 33, even the first light emitter 32, will light up to inform the user. In using, the user can click the switch key 310 to light up the first light emitter 32 in force so as to provide an illumination effect. Moreover, by the inner structure of the transparent distal cover 22, an interesting amusement effect is present.

In summary, the photo-pen with the function of displaying a phone calling and illumination in dark has combines the functions of writing, displaying mobile phone calling and illumination, and is a portable device.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A photo-pen with the function of displaying a phone calling and illumination in dark comprising:

a pen head having an inner pen tube for making a mark;

a pen body installed at a distal end of the pen head, having a battery therein and having a first section tube and a transparent second section tube;

an inducing light emitter received within the pen body and having an inducing circuit board electrically connected to the battery and is controlled by a switch key; wherein the inducing circuit board is installed with at least one first light emitter and at least one second light emitter; the first light emitter is placed at the distal end of the pen body and is covered by a transparent distal cover; and the second light emitter is placed at the second section tube.

2. The photo-pen with the function of displaying a phone calling and illumination in dark as claimed in claim 1, wherein the first section tube of the pen body is formed of metal.

3. The photo-pen with the function of displaying a phone calling and illumination in dark as claimed in claim 1, wherein one side of the transparent second section tube has a transparent clip.

4. The photo-pen with the function of displaying a phone calling and illumination in dark as claimed in claim 1, wherein the transparent distal cover has a plurality of parallel fiber tubes.

5. The photo-pen with the function of displaying a phone calling and illumination in dark as claimed in claim 1, wherein a plurality of small particles are formed on the transparent distal cover.

6. The photo-pen with the function of displaying a phone calling and illumination in dark as claimed in claim 1, wherein a plurality of bubbles are disposed in the transparent distal cover.

7. The photo-pen with the function of displaying a phone calling and illumination in dark as claimed in claim 1, wherein the transparent distal cover has a plurality of parallel fiber tubes and a plurality of small particles.

* * * * *